US005470150A

United States Patent [19]

Pardikes

[11] Patent Number: 5,470,150

[45] Date of Patent: Nov. 28, 1995

[54] SYSTEM FOR MIXING AND ACTIVATING POLYMERS

[76] Inventor: Dennis G. Pardikes, 12811 S. 82nd Ct., Palos Park, Ill. 60464

[21] Appl. No.: 107,345

[22] Filed: Aug. 16, 1993

Related U.S. Application Data

[63] Continuation of Ser. No. 572,411, Aug. 27, 1990, abandoned, which is a continuation-in-part of Ser. No. 540,910, Jun. 20, 1990, abandoned.

[51] Int. Cl.[6] ..... B01F 15/04

[52] U.S. Cl. ..... 366/137; 366/162.1; 137/566; 261/28; 261/DIG. 26

[58] Field of Search ..... 366/101, 181, 366/142, 165, 155, 136, 137, 159, 160, 337, 340, 172, 176, 342, 336, 338, 339, 264, 263, 161, 167, 107; 261/28, 77, 94, 121.1, 124, 122, DIG. 26; 422/901, 135, 234, 256; 137/563, 606, 896, 897, 98, 565, 566

[56] References Cited

U.S. PATENT DOCUMENTS

| | | | |
|---|---|---|---|
| 1,855,828 | 4/1932 | Flynn . | |
| 2,008,684 | 7/1935 | Craddock . | |
| 2,183,859 | 12/1939 | Chace . | |
| 2,272,573 | 2/1942 | Messmore | 366/263 |
| 2,272,721 | 2/1942 | McCoy | 103/41 |
| 2,651,582 | 9/1953 | Courtney | 106/187 |
| 2,917,465 | 12/1959 | Begley | 252/430 |
| 3,064,307 | 11/1962 | Sanborn | 18/2 |
| 3,067,987 | 12/1962 | Ballou et al. . | |
| 3,128,995 | 4/1964 | Schaeffer . | |
| 3,252,689 | 5/1966 | Blomgren, Sr. et al. . | |
| 3,298,669 | 1/1967 | Zingg | 366/107 |
| 3,321,283 | 5/1967 | Ewald | 23/283 |
| 3,322,507 | 5/1967 | Smith | 23/267 |
| 3,434,804 | 3/1969 | Winn | 23/285 |
| 3,508,882 | 4/1970 | Farnell | 23/285 |
| 3,559,959 | 2/1971 | Davis et al. . | |
| 3,607,105 | 9/1971 | Reid et al. | 23/267 R |
| 3,624,019 | 11/1971 | Anderson et al. | 260/29.6 |
| 3,709,828 | 1/1973 | Marks | 252/340 |
| 3,765,655 | 10/1973 | Latinen . | |
| 3,807,701 | 4/1974 | Reid | 366/176 |
| 3,846,515 | 11/1974 | Williamson | 261/28 X |
| 3,851,662 | 12/1974 | Jessop | 137/565 X |

(List continued on next page.)

FOREIGN PATENT DOCUMENTS

| | | |
|---|---|---|
| 380412 | 10/1985 | Austria . |
| 1572021 | 6/1969 | France . |
| 1195436 | 6/1970 | United Kingdom . |
| 1589306 | 5/1981 | United Kingdom . |

OTHER PUBLICATIONS

TAH Industries, Inc., "60 Series Stainless Steel Pipe Mixer" brochure, Feb. 1983.

The Watts Company's brochure on Nettco Flowmix, Aug. 1985.

*KOCH* Brochure Koch Engineering Company Inc. Static Mixing Application Report Water & Waste Treatment H–C1 Date Unknown.

*Primary Examiner*—Charles E. Cooley

*Attorney, Agent, or Firm*—Matthews & Associates

[57] ABSTRACT

An apparatus for mixing and activating polymer which includes the introduction of gas with water and polymer in order to create a variable density type foam which aids in the activation and enhances the efficiency of the polymer. The apparatus of the preferred embodiment provides the introduction of water and polymer into a mixing loop having a premixing manifold containing a static mixer, injecting or sparging gas into the outflow from the static mixer, blending and activating by mechanical agitation the water polymer and gas mixture, partially feeding back into the mixing loop the mixture to provide a desired level of polymer activation which is delivered at a desired rate of flow. This system provides capabilities for selecting the desired level of activation, levels of polymer concentration, levels of overall flow rate as well as controlling the various energy imparting elements of the apparatus.

11 Claims, 6 Drawing Sheets

U.S. PATENT DOCUMENTS

| | | | |
|---|---|---|---|
| 3,913,606 | 10/1975 | Anderson, Jr. | 137/565 X |
| 4,045,004 | 8/1977 | Berger | 366/159 |
| 4,051,065 | 9/1977 | Venema | 252/359 A |
| 4,057,223 | 11/1977 | Rosenberger | 137/892 X |
| 4,084,603 | 4/1978 | Howard | 137/88 |
| 4,093,188 | 6/1978 | Horner | 366/337 X |
| 4,125,574 | 11/1978 | Kastner et al. | 260/884 |
| 4,126,399 | 11/1978 | Schneider et al. | 366/159 |
| 4,127,233 | 11/1978 | Maciaszek | 239/8 |
| 4,190,617 | 2/1980 | Hope et al. | 261/28 |
| 4,217,145 | 8/1980 | Gaddis | 106/170 |
| 4,218,147 | 8/1980 | Rosenberger | 366/162 |
| 4,299,501 | 11/1981 | Patil et al. | 366/159 X |
| 4,356,131 | 8/1982 | Lipert | 261/77 |
| 4,365,988 | 12/1982 | Graham et al. | 71/34 |
| 4,396,529 | 8/1983 | Price et al. | 261/DIG. 26 X |
| 4,426,156 | 1/1984 | Adamo et al. | 366/181 X |
| 4,482,704 | 11/1984 | Luetzelschwab | 366/136 X |
| 4,506,986 | 3/1985 | Freeman | 366/142 |
| 4,522,502 | 6/1985 | Brazelton | 366/160 |
| 4,522,789 | 6/1985 | Kelly et al. | 239/113 X |
| 4,533,123 | 8/1985 | O'Leary | 366/167 |
| 4,533,254 | 8/1985 | Cook | 366/176 |
| 4,539,120 | 9/1985 | Robinson | 366/101 X |
| 4,584,002 | 4/1986 | Cox et al. | 261/DIG. 26 X |
| 4,601,645 | 7/1986 | Schmitkons | 261/28 X |
| 4,642,222 | 2/1987 | Brazelton | 366/160 X |
| 4,664,528 | 5/1987 | Rodgers et al. | 366/142 |
| 4,688,945 | 8/1987 | Brazelton et al. | 366/156 |
| 4,744,959 | 5/1988 | Punzar | 366/167 |
| 4,747,691 | 5/1988 | Hoffland | 366/160 |
| 4,778,280 | 10/1988 | Brazelton | 366/181 X |

SYSTEM FOR MIXING AND ACTIVATING POLYMERS

This application is a continuation of application Ser. No. 07/572,411, filed Aug. 27,1990, now abandoned, which is a continuation in part of U.S. application Ser. No. 07/540,910 filed Jun. 20, 1990, now abandoned.

BACKGROUND OF THE INVENTION

1. Field of the Invention

This invention relates to a method and apparatus for mixing and activating synthetic organic polymers at a relatively high rate in either batch or continuous loads and being able to control, select, alter or maintain the polymer concentration and activation.

The use of synthetic organic polyelectrolytes has grown rapidly over the past two decades. Only a few years ago, a U.S. Environmental Protection Agency listed only approximately 450 polymer products approved for use in potable water treatment systems. Today, over 1,000 synthetic polymer formations have been approved for use in potable water production and as many as 10,000 variations may exist in all liquid/solid separation applications worldwide, In classifying synthetic organic polymers commonly used in water treatment, it is important to consider charge type, product form and relative molecular weight. The charge may be anionic, cationic or nonionic. The polymer may be a dry powder, a solution (in water), or an emulsion. Relative molecular weights vary from low to very high. Unactivated or neat polymers are encased by an oil carrier. In this phase, a molecule is coiled upon itself. Due to its charge, and as it tries to uncoil the oil carrier overcomes the charge and keeps it coiled.

As appropriately stated in the article "Characterization of Synthetic Organic Polyelectrolytes Used in Water Treatment" by Beth M. Gucciardi and Dr. Steven K. Dentel, PhD, presented to the Chesapeake section of the American Water Works Association, > [A]s a general description, a polymer can be defined as a chemical compound made up of repeating structural units which are comprised mainly of carbon and hydrogen. The structural units, or monomers are linked together to form long chains in a process called polymerization. If the monomers are positively charged, the polymer is referred to as cationic. When the polymer is comprised of negatively charged units, it is termed anionic. If the net charge on the polymer is zero, it is described as nonionic. A typical cationic polymer contains positively charged nitrogen atoms on some or all of its repeating units. An anionic polymer may get its charge from negatively charged oxygen atoms. An anionic polymer can result from either equal combination of negative and positive units or from the absence of charge units along its chain. If a polymer is made up of only one type of repeating unit, or monomer, it is a homopolymer. If two types of monomer uniformly alternate along a polymer backbone, it is a copolymer. The number and type of repeating units comprising a polymer molecule determine its molecular weight. Since many monomer units are require to make up a polymer, these weights are high, ranging from ten thousand to ten million.

Liquid, or emulsion, polymers are dispersions of high solids synthetic polymer gels in hydrocarbon oil. The molecules in the gel are coiled and considered inactive and in their continuous phase. The advantage of supplying a polymer in its continuous oil carrier phase is primarily its ease of shipping and storage life. Polymers are highly polar due to the amide and carboxyl groups. This gives the polymer a great affinity for water but an aversion to oil. A polymer is considered inactive until blended with a good solvent such as water to initiate the hydration (activation) process.

Polymer gels are colloidal suspensions in which the dispersed synthetic polymer phase has combined with the continuous aqueous phase to produce a semi-solid material. Gels are also fluid-like colloidal systems consisting of long-chain, nitrogen-containing, macromolecules in a semi-solid form. Emulsions are dispersions of high-solids synthetic polymer gels in hydrocarbon oil. All solid synthetic polyelectrolytes result from differences in processing of polymers prepared in aqueous solutions, or in an aqueous phase of a suspension. The synthesis results in a rigid, tough, rubber gel. Processing the tacky gel particles, with heat, produces the "dry" or "powder" solid polyelectrolyte product.

Liquid polymers are used by industry to simplify their industrial processes and make them more economical. For example, liquid polymers may be used for water purification and flocculation; may be used in automotive paint spray booths to detackify paint; may be used in the chemical industry to separate inorganics and other solids from plant effluent; may be used in the coal industry to promote solids settling and recover fine coal; may be used in the petroleum industry to enhance oil recovery; may be used in the phosphate industry to process tailings; may be used in the pulp and paper industry as retention and dewatering aids; and may be used in the steel industry to settle wastes. Those familiar with this technology and art will readily perceive many more uses in still other industries.

Polymers in liquid form are normally supplied in 5 gallon containers, 55 gallon lined drums, 350 gallon portable bin containers, 5,000 gallon tank trucks, and 10,000 to 30,000 gallon railroad tank cars. Usually emulsion polymers are shipped in their continuous phase (nonactivated) to the location where they will be used. At that location, it is necessary to activate the polymers. Usually that means that a polymer must be inverted in an electrolyte solution, usually water, to its discontinuous phase (active). The process for so converting the polymer into an active state is one of imparting a sufficient amount of energy to the polymer.

The exact amount of energy required for the activation of an emulsion polymer is factor dependent. Variations in molecular weight, solution concentration, water constituents, and percent active solids may affect she amount of energy needed to properly invert the polymer. When the polymer has been inverted, there is likely to be an increase in viscosity of the polymer solution. The increase in viscosity is due to the extended molecules entirtwining with each other. With the polymer molecule extended, polymer-polymer entanglements can be maximized.

2. Description of the Related Art

As noted above, the process for activating polymer requires a sufficient amount of energy on the polymer in order to break and disperse the polymer gel and allow the molecules to extend. Reference may be made to U.S. Pat. No. 4,057,223 issued to Mr. Roy R. Rosenberger and U.S. Pat. No. 4,217,145 issued to Mr. Preston G. Gaddis for examples of prior art polymer activating systems.

The polymer gel encased in the hydrocarbon carrier is inactive, and therefore, its hydrocarbon barrier must be neutralized to allow contact between the electrolyte, solutes and cosolutes and thus allow the ionic molecule to hydrate.

The way in which emulsion polymers are activated includes diluting them with a solvent (water) and adding enough mixing energy to emulsify the oil carrier and enable the ionic charge molecule to uncoil. More particularly, the energy imparted to the inactive polymer includes a mechanical agitation which breaks down the lipid barrier and thus enables water or another electrolyte to reach the long coiled molecule. Once that molecule is in water, the repulsive interactions between the fixed charges on the polymer chains uncoil the molecule to expose its reactive sites. Until this uncoiling occurs, the molecule is useless for most purposes.

The known activation systems have required relatively long periods of time, up to and even over an hour, in order to complete the activation of the polymer. In order to satisfy the time requirements often prior art systems utilize aging or auxiliary retention chambers where the activated polymer is allowed to sit while the molecules untangle and extend. This additional period of time increases the requirements and capacities for holding and aging tanks during activation. Therefore, the relatively long activation time can become very expensive. Also, the requirements for such a long term for activation greatly increases capital requirements for the purchase of machinery when a system is operating continuously. Thus, a faster, more efficient activation system is highly desired.

Primarily, the prior art used the batch method to activate liquid polymers. Polymer and water are delivered to a common mixing tank. Once in the tank, the solution is beat or mixed for a specific length of time in order to impart energy thereto. After mixing, the resulting solution must age to allow enough time for the molecules to unwind. This method, due to its inefficient mixing and localized shear planes, did not necessarily yield the highest quality polymer solution.

Other prior art shows continuous in-line mixers as well as in-line static mixers. Standard mixers utilized for mixing and feeding are shown in U.S. Pat. Nos. 4,522,502 and 4,642,222 issued to Carl Brazeitoh, as well as U.S. Pat. No. 4,747,691 issued to Robert O. Hoffland. Examples of prior art static mixers can be found in U.S. Pat. No. 4,051,065 issued to Gerard J. Venema, as well as U.S. Pat. No. 3,067,987 issued to Sidney R. Ballou, et el.

Accordingly, one purpose of this invention is to provide a new and improved means and methods for activating polymers. In particular, to provide a quicker, multi-stage procedure which lends itself to the either batch or continuous processing and provides a means of structuring the polymer molecule to yield higher levels of activated product.

Another object of this invention is to provide a means for activating polymers which provides an inexpensive way to enhance the productivity of systems currently in place. Consequently, it is an object of the present invention to provide an automatic, continuous system which is able to vary the output rate of inverted polymer, while automatically maintaining the amount of energy imparted thereto and a desired concentration of the polymer in a quick, efficient and relatively inexpensive manner.

Still another object of the present invention is to substantially reduce, and in many cases completely eliminate, the aging time which in turn reduces the capital expenditures required to install a polymer mixing and activation system.

SUMMARY OF THE INVENTION

Basically, the inversion of a polymer normally occurs in four stages, which are: premixing; blending; recycling; and a final sudden pressure reduction. The premixing occurs in a manifold containing a static mixer. The blending occurs within a centrifugal pump where water or another electrolytic substance (or mixtures thereof) are blended with the polymer. However, prior to the mixture entering the pump, the present invention calls for the injection of some type of gas thereby creating bubbles or "foam" in the mixture or foam. The outpouring stream from the centrifugal pump divides with part of the outflow feeding back through the static mixer. The other divided part of the outflow is delivered to a mixing pressure regulator where the pressure imparted by the centrifugal pump is suddenly reduced to, or near, the atmospheric pressure. This suddenly relaxes the long coil polymer molecule to hasten its straightening.

As noted above, the premixing occurs in a manifold containing a static mixer. The premix manifold is where the neat polymer and water first meet. The outflow through the premix manifold is a solution or polymer and water which normally yields a greater viscosity than water alone. Therefore, the neat polymers introduced into a viscous polymer solution in which the similar viscosities lend themselves to an enhanced mixing environment. The principle of like organic materials (in this case polymers) dissolving in like organic solvents is known. This principle has been referred to as "seeding", and is incorporated into the present invention. The addition of a small amount of organic material to a nonorganic solvent, aids in the solubilizing of like organic substances. Newly introduced polymer (organic material) is immediately mixed in with polymer solution (organic solvent) to promote rapid solubilizing in the present invention.

It is normally after the polymer solution exits the premix manifold that a third substance, gas, is added to convert the polymer solution into a variable density type foam. This type of polymer solution can be said to be a material made up of gas bubbles separated from one another by films of liquid (i.e., polymer solution). The bubbles may be spherical in nature and the liquid film separating them may be approximately 0.5 mm or greater in thickness.

Ideally, the introduction or "sparging" of a gas into the dilution water, polymer solution should be controlled so that the resulting gas bubbles range in size from 0.1 to 100 microns in diameter in the preferred embodiment. There are a number of high density porous metal nozzles or static mixers manufactured in many different configurations available to properly sparge the gas used. (These nozzles include those manufactured by Newmet Krebsoge.) It is known that in a viscous environment, smaller gas bubbles will tend to coalesce into larger gas bubbles unless rapid mixing is available to evenly disperse the bubbles in the solution meeting. One type of rapid mixing is present in the blending stage of the present invention. The blending occurs in a modified centrifugal pump where water (or any other solvent or electrolyte), or mixtures thereof (cosolvent), and gas are blended with the polymer. In this stage, rapid dispersion of the organic product with gas produces a foam structure with bubble sizes ranging from approximately 1 to 1000 microns while preparing the solution to its desired homogeneity and concentration. Smaller and larger sizes may randomly occur and may be present.

To a greater or a lesser extent the bubbles will be controlled by varying the speed of the impeller in the blending pump. This is an important aspect when changes in molecular weight and ionic charge, solute and cosolute charge and solution concentration impact on the interface process and subsequent conformational change to the polymer molecule. The useful impeller rotational speed for this application is approximately 1,000 to 10,000 RPM. Additionally, the configuration of the impeller is important in shaping the dispersion forces. The impeller can be of an open or closed design, turbine or centrifugal in nature, with a varying effective diameter or axial width.

The outflowing stream in the blending pump provides that part of the outflow feed back to the premix manifold, static mixer and blending pump. This is the recycle stage. The amount of recycle is controlled by the recycle orifice and the mixing pressure regulator. That portion of the blending pump outflow directed through the premix manifold mixes with the newly injected concentrated polymer. The ongoing process of supplying polymer solution for the premix stage is supplied through the recycle circuit.

The divided part of the outflow is delivered to a mixing pressure regulator where the pressure imparted by the blending pump is suddenly reduced to, or near atmospheric pressure. This sudden pressure reduction is the final mixing stage.

While the gas is normally introduced prior to the solution entering the blending pump it can be introduced at other locations in the system. Further, there is no requirement that all of the above described stages be included in a single system for operability. Merely mixing the polymer and water with the injection of gas, for example, may achieve the desired result.

It has been suggested that the polymer molecule can be visualized as fibrous aggregate. Each polymer fiber may include as little as 1 and as many as 3,000 molecules. In a good solvent, the polymer molecule must extend and maximize its contact with the solvent. When this happens, polymer-polymer entanglements are maximized increasing the apparent viscosity.

The creation of a polymer/foam system increases the apparent viscosity and activity of the solution beyond what was thought to be possible using conventional methods of polymer inversion. It is not unusual to see a substantial viscosity increase at a 1500 ppm level (active polymer) and an even greater increase at the 6000 ppm level over anticipated levels. Additionally, the time to achieve these levels of viscosity is greatly accelerated over the current prior art. In some cases, instant maximum levels of viscosity can be obtained. The inventor considers the effects of the adsorbed polymer molecule with the water/air interface responsible for the change in the solution behavior.

The common assumption of the theoretical treatment of polymer adsorption is that the polymer chain is formationally flexible. The adsorption behavior of these polymers at the water/air interface first comprises the diffusion of the molecule to the interface followed by the actual adsorption step which involves some rearrangement of the conformation of the polymer. This rearrangement in the molecule is reflected in corresponding increases in the apparent solution viscosity. The rearrangement takes place more easily, it is believed, in light of the fact that the surface area of the molecule is expanded due to the water-air interface created by the foam structure. This interface increases the available ionic charges due to the improved molecular arrangement caused by the abundance of adsorption sites at the interface. Simply stated, the molecules can and will expand more easily when the conditions are less restrictive.

DETAILED DESCRIPTION OF THE PREFERRED EMBODIMENT

Figure 1:
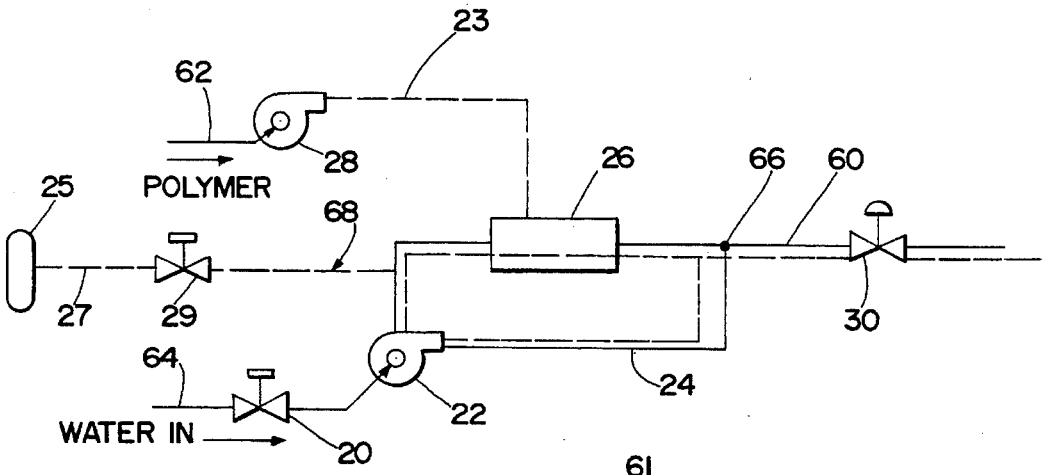
FIG. 1 schematically shows the principles of an inventive system having two inputs which are for water and for the polymer that is to be activated.

FIG. 1 shows a basic diagram of one of the basic preferred embodiments for the present invention. In FIG. 1, the system components are an input throttling valve 20 for controlling the ratio of water (or any other solvent or electrolyte) to polymer, a centrifugal pump 22 for introducing the water, a closed mixing loop 24, a gas holding vessel 25, which could also be an air compressor or the like, a gas input line 27 providing a pathway for the gas to enter into the feedback loop line 68, a premixing manifold 26, and a positive displacement pump 28 for introducing the polymer. The water and polymer first meet in the premixing manifold 26, the water flow being indicated in FIG. 1 by solid lines the polymer flow being indicated by dashed lines. Valves 20 may be set to provide a ratio of water of about 1% polymer in one example, with a useful range of ratios being on the order of 0.25 to 15% polymer. Associated with valve 20 may be a meter (not shown) which is calibrated in gallons per minute or to whatever measurement is desired. By adjusting valve 20, one can select the desired output of the entire system. Valve 29 is also provided in order to allow the operator to regulate the gas being injected into the system The greater the volume of gas injected the higher the foam density. Valve 29 is preferably a Fairchild Model 59A Differential Pressure Regulator or similar device.

The mixing pressure regulator 30 is important in three areas. It is used to maintain a constant net positive discharge head on the booster module or centrifugal pump 22, it controls the amount of recycling which occurs in the recycle stage and it provides a variable pressure drop zone in the final state and enables the operator to select a proper amount of mixing energy, based on the type and concentration of polymer being processed. The higher solids polymers and higher solution concentrations require more mixing energy than usual.

Figure 2:
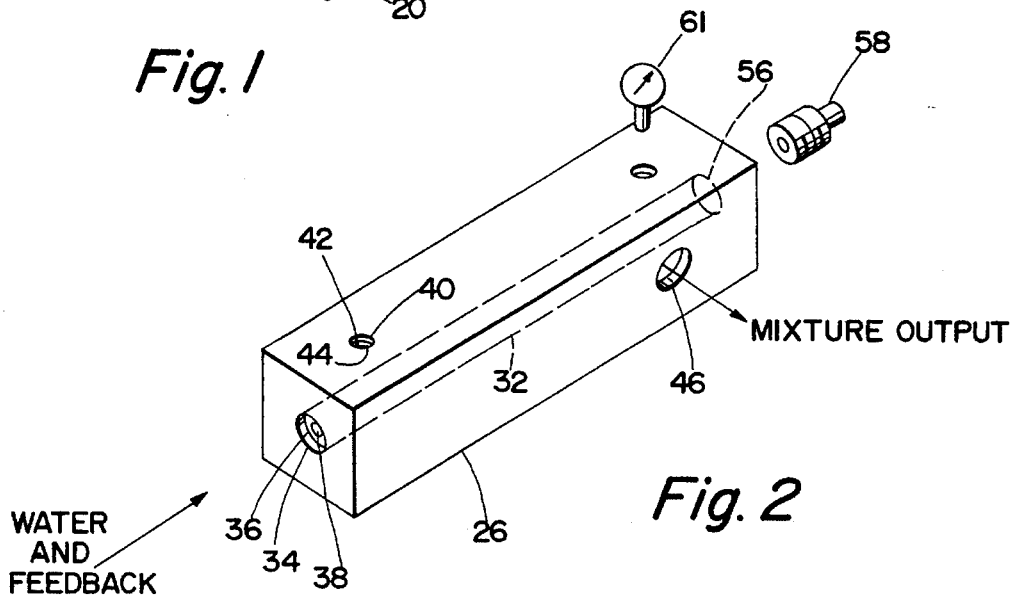
FIG. 2 is a perspective view of a pre-mixing manifold.

In greater detail, the mixing manifold 26 (FIG. 2) is, for example, a solid block of metal having a central bore 32 extending through substantially its entire length. The bore 32 stops short of a counterbored and threaded feedback input opening 34, to form a bulkhead 36. An orifice 38 of fixed diameter is formed in the center of the bulkhead 36 to establish communication between the water and feedback inlet opening 34 and the central bore 32, with a flow rate that is controlled by the orifice diameter. Also shown in FIG. 2 are plug 58 which is inserted into the mixing block opening 56 so as to direct fluid flow through the appropriate channels and pressure gauge 61.

A first transverse, threaded hole 40 leads to another bulk head 42 between the entrance to the counter bored and threaded hole 40 and the central bore 32. An orifice 44 is formed in the bulkhead 42 to establish communication and to control the flow rate between the hole 40 and the central bore 32. The output port 46 is in direct communication with the central bore 32 to give an unimpeded outflow of a mixture of polymer and water.

Figure 3A:
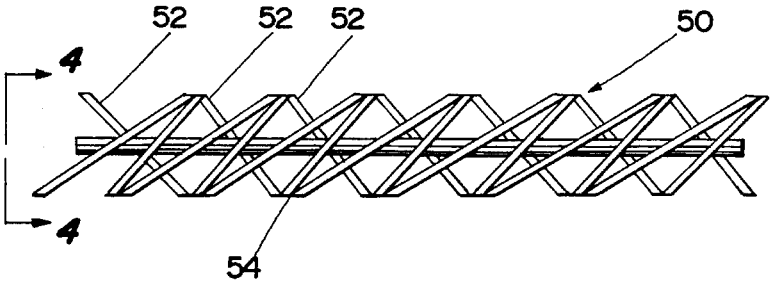
FIGS. 3A and B are two plan (rotated by 90' from each other) views a static mixer which is used inside the manifold of FIG. 2.
Figure 3B:
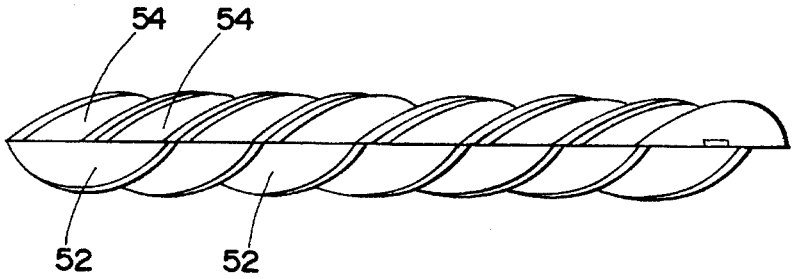
Figure 4:
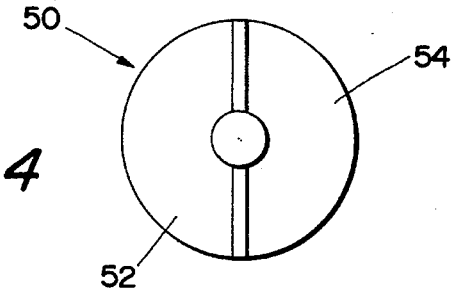
FIG. 4 is an end view of the static mixer, taken along line 4—4 in FIG. 3A.

A static mixer 50 (FIGS. 3,4) comprises two sets of semi-elliptical baffles which are set at an angle to each other so that the over all end view configuration is a circle (FIG. 4). The baffles 52 (FIG. 3A) on one side of the static mixer are a series of spaced parallel plates. The baffles 54 on the other side of the static mixer are joined on alternate ends to give an over all zig-zag appearance. The outside diameter (FIG. 4) of the static mixer Corresponds to the inside diameter of the central bore 32. Therefore, the static mixer 50 slides through an end opening 56 and into the bore 82. Thereafter a plug seals off the end of the bore. In one embodiment, the static mixer 50 is a standard commercial product from TAH Industries of Inlaystown, N.J.

Water is introduced into the mixing loop 24 (FIG. 1) through the centrifugal pump 22 and is controlled and metered by the throttling flow valve and meter at 20. The beginning stages of activation or pre-blend stage occurs inside the centrifugal pump assembly 22.

The centrifugal pump 22 is preferably derated on the high end of its output flow by a factor in the order of 2 to 7, for example, for most applications. On the low end of its output flow, the derating factor may be much higher. That is the diameter or width of the impeller is trimmed to give a derated performance wherein there is a larger amount of stirring and mixing per volume flow. Derating is also controlled by an adjustment of the water inlet flow. In greater detail, by way of example, a centrifugal pump usually has a series of flow charts which are supplied by the manufacturer. One flow chart, which may be the one normally used, may describe how the pump could provide a flow of 20-gallons per minute to the top of a 40-foot head, for example. Another flow chart may describe how the same pump could be operated at a different speed to provide five times that capacity, or at 100-gallons per minute to the same 40-foot head, in this particular example.

According to the invention, the pump is operated in a manner to deliver 100-gallons per minute, but the configuration of the impeller is modified in combination with the water valve until the delivery returns to 20-gallons per minute, while the pump continues to be operated in the manner which the manufacturer suggests for 100-gallons per minute. Thus, in this particular example, the centrifugal pump has been derated by a factor of 5 (i.e., derated from 100-to-20-gallons per minute). After derating, the increased a impeller speed, which is normally required to deliver 100-gallons per minute imparts a higher level of energy to the mixed fluid, without increasing the volume of fluid output.

The unactivated emulsion polymer is introduced through the premix manifold 26 and into the mixing loop 24 by a variable speed, positive displacement pump 28 which delivers the polymer at a rate which achieves a range of desired concentrations. A calibration column (not shown) is provided to correlate the variable speed pump 28 to its capability to deliver the unactivated polymer at a rate which accurately obtains the desired concentration. The pump 28 delivers the polymer to the mixing manifold 26.

The mixed water and polymer solution is recycled, via loop 24, back through the premix manifold 26 and the booster module (centrifugal pump 22) which continues to boost the activation level of the polymer.

It is at this point that the gas is introduced into the system. The gas, whether it be oxygen, nitrogen, or a combination of gases, or any gas deemed a suitable alternative, would normally be stored in some type tank 25 or possibly generated by a simple compressor. The amount of gas entering the system is controlled by he valve 29. The gas is introduced into this system at the point just before centrifugal pump 22 and after the solution has exited to manifold 26. This normally provides the introduction of gas to be conducted in the feedback line 68. While this is the generally preferred point of introducing gas for this preferred embodiment, injection of the gas at any point in the system should provide substantial beneficial results. For instance, the gas could be injected into the inlet water line, directly into the centrifugal pump 22 into the system in the portion of the feedback loop designated as 24, directly into the premix manifold, just prior to the mixing pressure regulator 30, or downstream of the regulator.

As noted above, ideally the gas should be sparged into the polymer solution in such a way that the resulting gas bubbles range in size from 0.5 to 100 microns in diameter. There are a number of types of metal nozzles satisfactory for this purpose such as the nozzle manufactured by Newmet Krebsoge in Terryville, Conn. One other advantage to introducing the gas in feedback line 68 is that by controlling the rotor speed of the centrifugal pump 22 the operator is able to control the size of the bubble and effectively enabling him or her to fine tune the process depending on the type of polymer being utilized. In a viscous environment such as this, the smaller gas bubbles may tend to coalesce unless rapid mixing is available to evenly disperse the bubbles in the solution medium. In the present preferred embodiment this rapid mixing occurs in the blending stage which occurs in the centrifugal pump 22. In this stage, rapid dispersion of the organic product with the gas produces a foam structure with bubbles ranging from 1 to 1,000 microns while also preparing the solution to its desired homogeneity and concentration. The useful impeller rotational speed for this application is 1,000 to 10,000 RPMs. Further, the impeller configuration is also important in shaping the dispersion forces. The impeller can be that of an open or closed design, turbine or centrifugal in nature, with varying effective diameters or axial widths.

The outflow from the blending pump 22 is divided with part feeding back through the premix manifold. This is the recycle stage. The amount of recycle is controlled by the recycle orifice 38 as well as the mixing pressure regulator 30. That portion of the blending pump outflow which is directed through the premix manifold mixes with the newly injected concentrated polymer received from pump 28.

The final stage of polymer inversion is controlled by the mixing pressure regulator 30. The polymer solution passing through the regulator 30 experiences a sudden pressure drop which fully inverts the solution. This pressure drop is adjustable and represents an important factor in the development of fully activated polymer molecules. The pressure regulator 30 is a standard commercial item.

More specifically, the mixing pressure regulator 30 is provided in the mixing loop to enable a discharge of the inverted polymer at a desired level of activation while, maintaining a net positive suction head in the centrifugal pump to prevent cavitation. Once the desired output rate and level of activation is selected, the mixing pressure regulator 30 automatically compensates for any surging or ebbing flow which are attendant upon changes in the output flow rate. Thus pressure regulator 30 maintains the desired level of blending in the centrifugal pump 22.

It should be noted that the mixing pressure regulator is important in three areas. It is used to maintain a constant net positive discharge head on the booster module, which is an important consideration in thee hydraulics of the system. It controls the amount of recycling which occurs in the recycle stage. It provides a variable pressure drop zone in the final stage and enables the operator to select a proper amount of mixing energy, based on the type and concentration of polymer being processed and the type and amount of gas injected. The higher solids polymers and higher solution concentrations require more mixing energy than usual.

Regulator 30 is set to cause a sudden and abrupt relaxation of pressure, from the pressure in line 60 to or near atmospheric pressure. This sudden and abrupt relaxation causes an effect which is somewhat similar to the aging which occurs in aging or retention tanks in prior art systems.

In operation, the invention provides an automatic system for activating emulsion polymers and dispersing solution polymers at desired output rates and desired levels of activation. The system provides homogenous, activated, solutions at desired concentrations. The system is fast, inexpensive, reliable, and provides variable capabilities which are not offered by other known systems.

More particularly, the system takes in polymer at inlet 62 and water at inlet 64. The throttling valve 20 is se to regulate the amount of inflowing water and, therefore, the ratio of water to polymer. The diameters of the pipes, apertures, impedance of the static mixing device 50, etc. cause an outflow of pump 22 to divide at point 66. The ratio selected for the division depends upon the nature of the product. In an exemplary system, about 40%–95% of the outflow of pump 22 passes through pipe 60 and the pressure regulator 30 to the output of the system. The remaining approximately 60%–5% of the outflow from pump 22 recirculates to the pre-mixing manifold 26, from which, it is fed back to the centrifugal pump 22. At this point the gas is injected into the feedback line.

It should now be clear that the preferred embodiment of the present invention has four stages: pre-mix, blend, recycling, and final stage. However, the procedure could still be accomplished utilizing only the blending stage. One or both of the other stages can be included at the operator's discretion. The pre-mix occurs in the mixing manifold 26 when the raw polymer first meets the water. The turbulence caused by baffles 52, 54 (FIG. 3) or the static mixer 50 tends to thoroughly mix the polymer and water, but the hydrocarbon carrier surrounding the coiled polymer molecule may remain unbroken. As opposed to the static mixer, a power mixer may also be used.

The blend stage starts in the centrifugal pump 22 where the oil barrier begins to be or is broken, at a first level of activation. This blending occurs after gas has been injected and will normally create a "foam" in the solution. By merely injecting the gas into the polymer and water mixture enhances and improves the efficiency of the polymer.

The recycling stage occurs in the feed back loop 24 where about 5%–40% of the outflow of pump 22 continues to receive an imparted amount of energy to invert the solution. A level of equilibrium and stability is soon reached wherein virtually all of the solution is inverted by the time that the outflow reaches the outlet pipe 60, where the polymer is to become fully activated.

The final stage occurs when there is a sudden pressure drop in regulator 30 which relaxes the polymer molecule. Then, the similar charges along the long polymer molecule repel each other and cause it to straighten in response to the sudden reduction of pressure in regulator 30.

Figure 5:
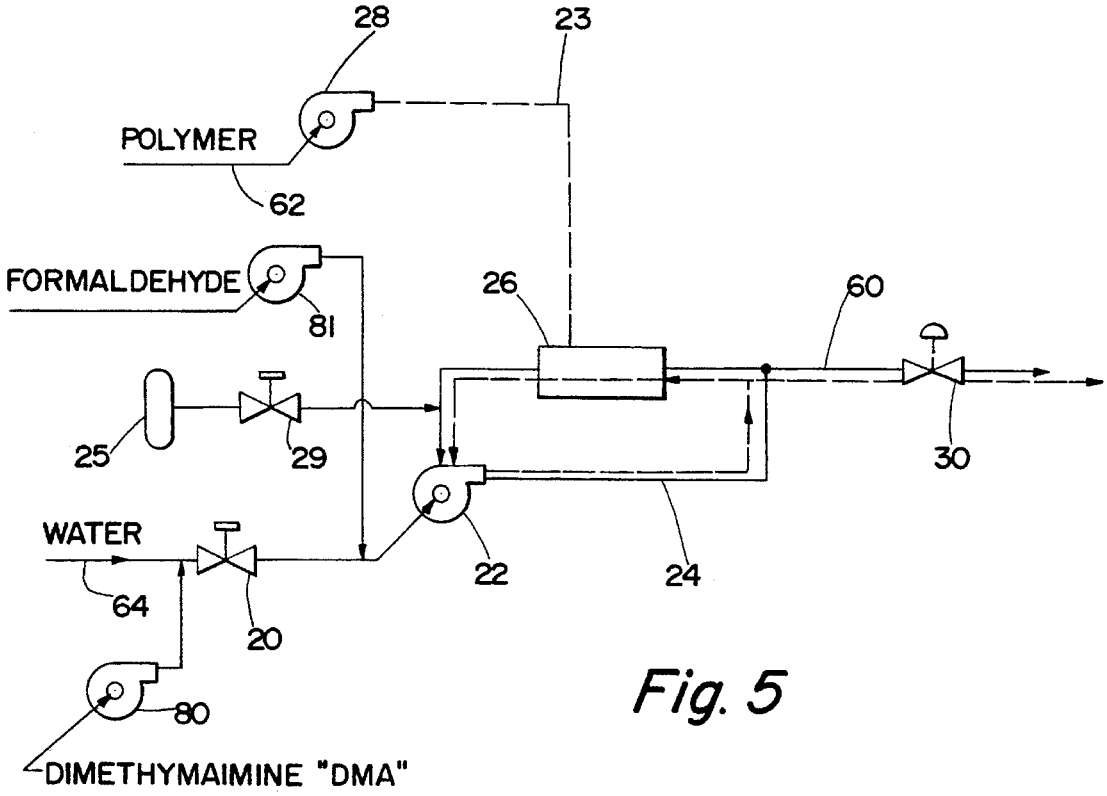
FIG. 5 is a schematic showing of a more sophisticated version of the system of FIG. 1 with provisions for introducing one or more chemicals which may be used in the electrolyte for activating the polymer.

The principles and the apparatus described thus far may be expanded and modified to provide systems which are custom designed for activating various polymers in various electrolytes. Some of these changes are illustrated in FIG. 5 where the format of the piping system has been modified to mix a polymer with, not only water, but also additional chemicals. In this particular example, the polymer is mixed with dimethylamine ("DMA") and formaldehyde. In its pure form, DMA is a highly flammable material which should not be brought into a factory. Therefore, DMA is introduced via a pump 80, the output of which is connected to the water input pipe 64 while it is outside the factory and before it reaches the throttle valve 20. After the DMA is mixed with water, it may be safely pumped into the factory.

The formaldehyde may safely be handled within a factory area; therefore, it is introduced via pump 81 which may be at any convenient location. The formaldehyde is injected into the mixture of water and DMA before it reaches the pump 22 and the polymer.

The remainder of the system in FIG. 5 is the same as the system of FIG. 1. Therefore, it will not be described again. The outflow from pressure regulator 30 is a composition comprising a polymer mixed into a carrier of water, gas, DMA, and formaldehyde.

Other alterations that can be made to the general system relates to the point the gas is injected into the system. First, one should consider the surfactant properties of the polymer being activated when determining the specific location for the air injection point. The more surfactant the less mixing with the air is desirable sine too much foam may be created or the density may be effected. As noted above, the preferred known location for injection at this time is in the recycle line. It may also be possible to inject a gas at a point into the polymer inlet line 23 prior to the polymer entering the manifold 26. Another possible location for the gas injection could be in the output line 60 prior to the pressure drop. Still another location for the gas injection input may be in the water inlet line 64. Still another is downstream of the mixing pressure regulator.

As suggested above, the size of the bubbles can also be affected by the size and speed of the impeller and the blending pump 22. With a rotor speed of 1140 RPM the foam created will incorporate bubbles which are rather large by increasing the speed to 3000 or even 6000 RPM the bubbles will be smaller and even better dispersed. Subsequently, the preferred embodiment will utilize an impeller rotation speed between 1140 and 10000 RPM.

Figure 6:
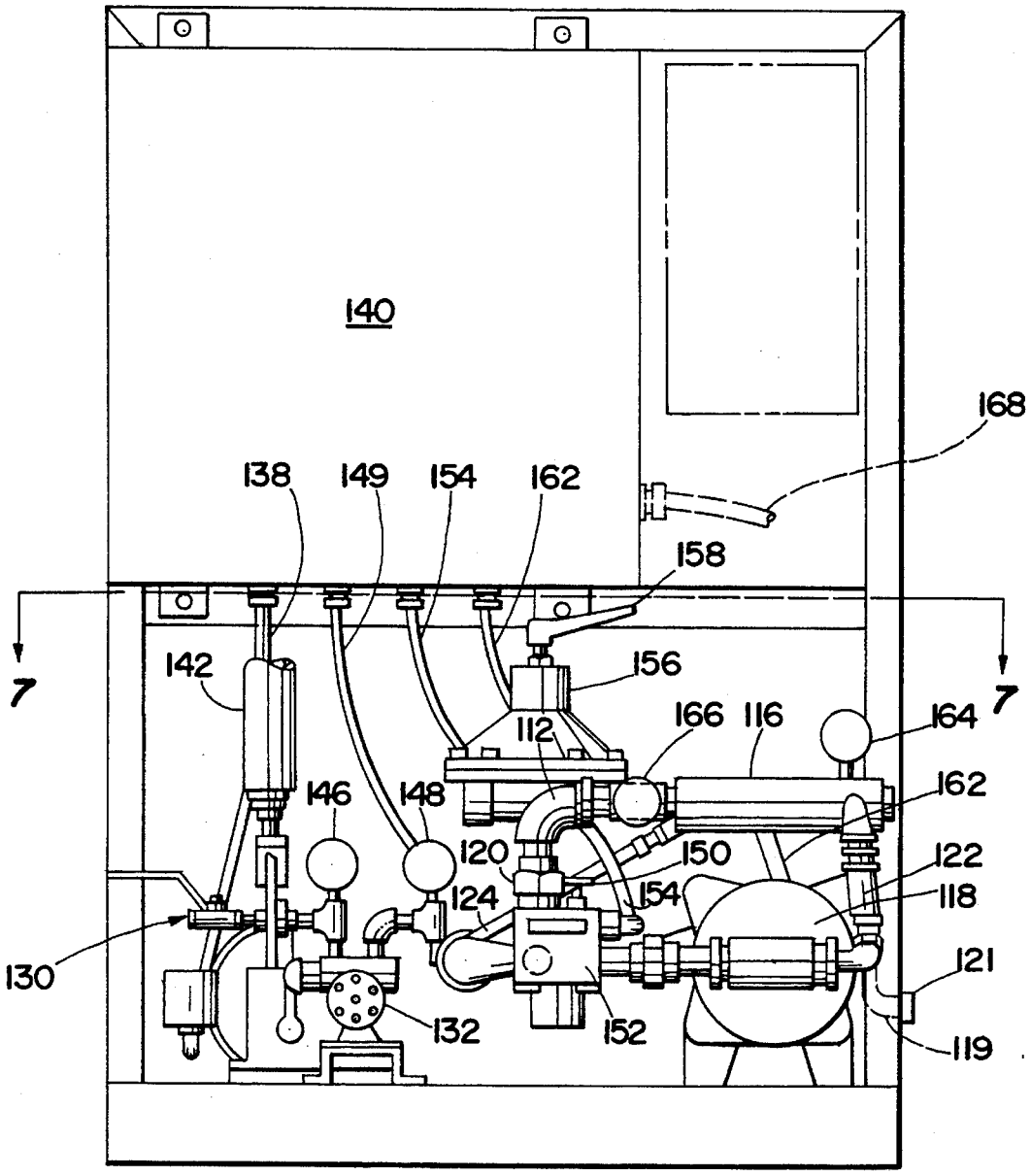
FIG. 6 is a front plan view of a system incorporating the invention.
Figure 7:
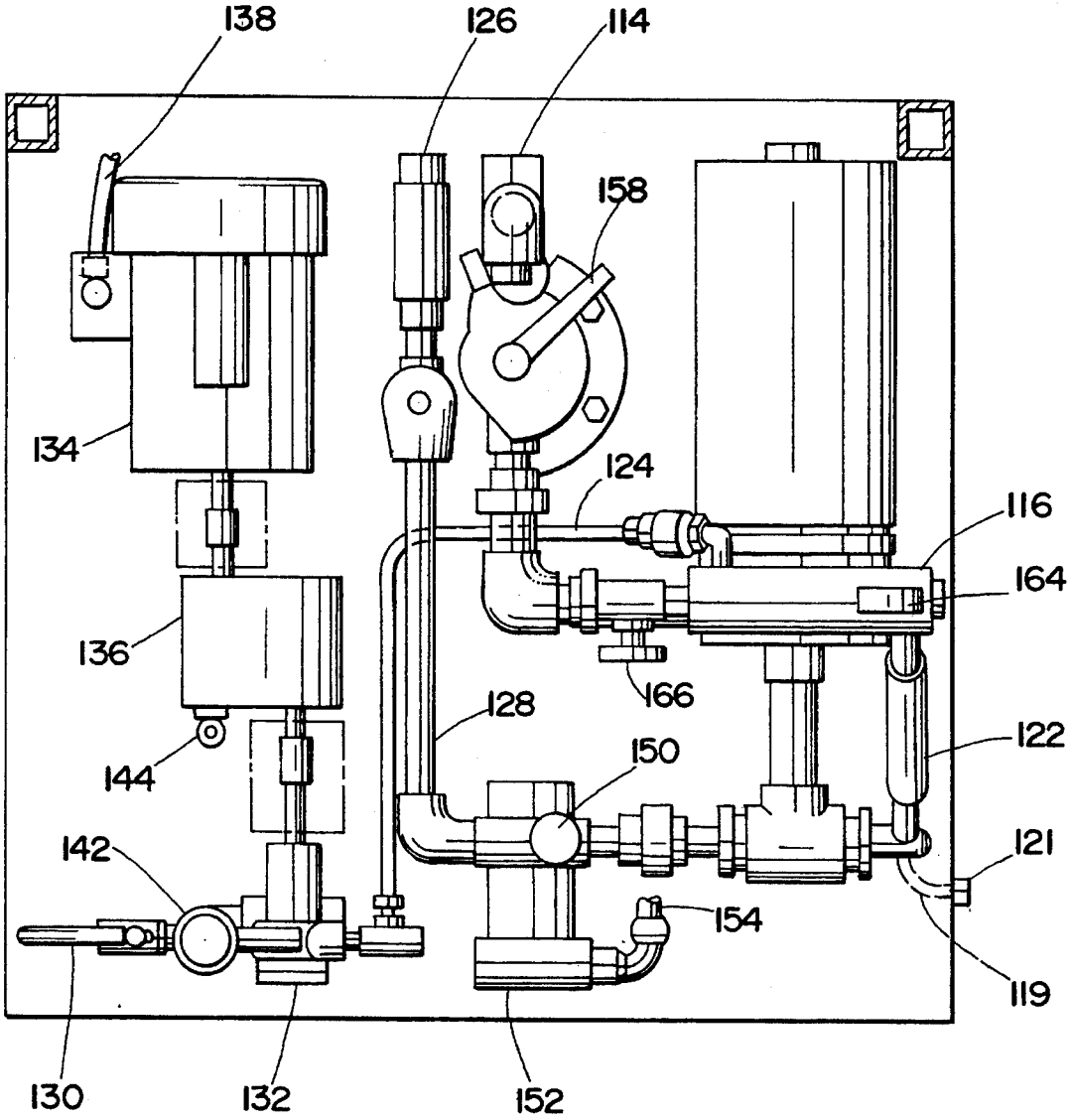
FIG. 7 is a plan view of the inventive system taken along lines 7—7 of FIG. 6.
Figure 8:
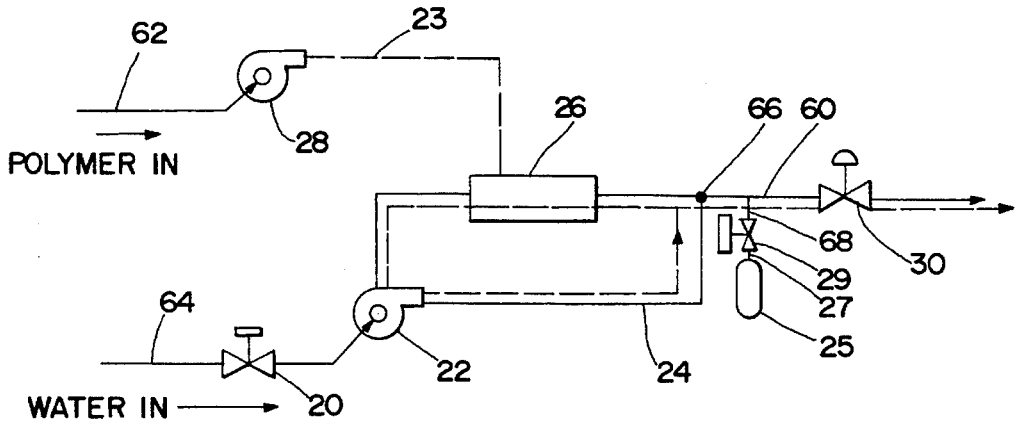
FIG. 8 is a schematic of an alternative embodiment wherein gas is injected after the water and polymer is mixed.
Figure 9:
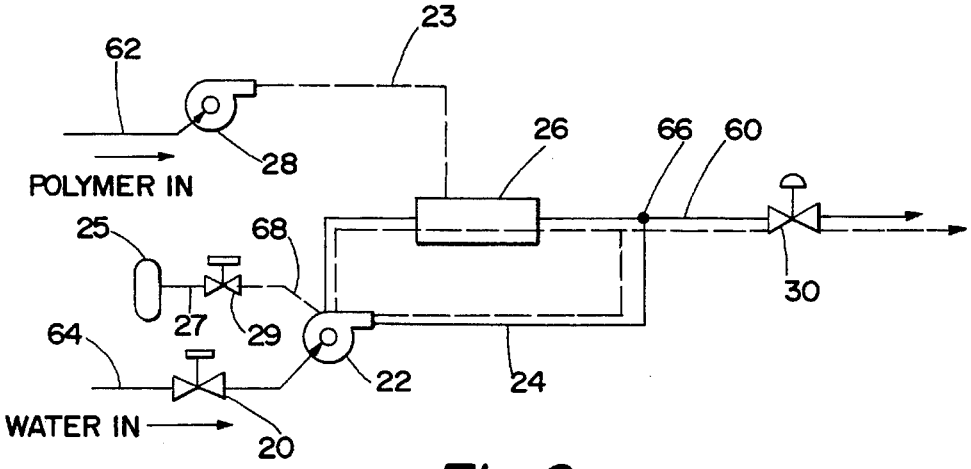
FIG. 9 is another schematic of an alternative embodiment wherein gas is injected into the solution at a mixing pump.
Figure 10:
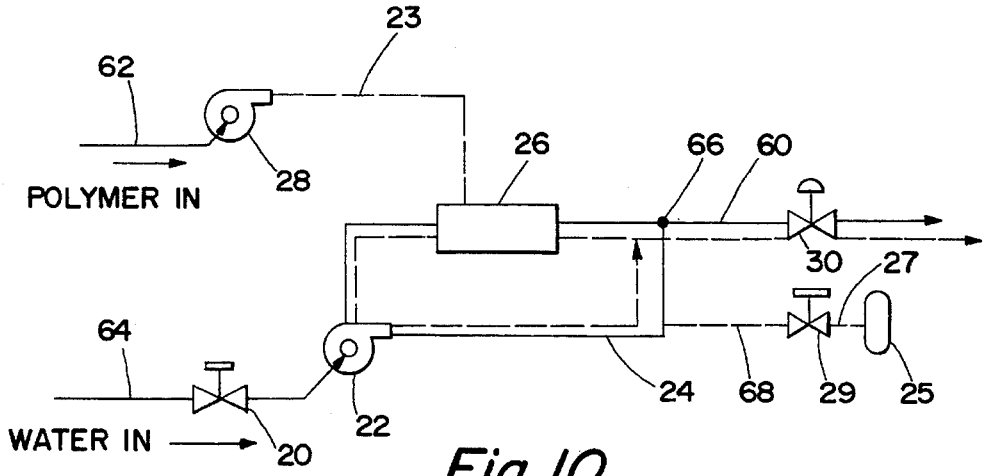
FIG. 10 is still another schematic of an alternative embodiment wherein gas is injected after the polymer and water have exited the pump.
Figure 11:
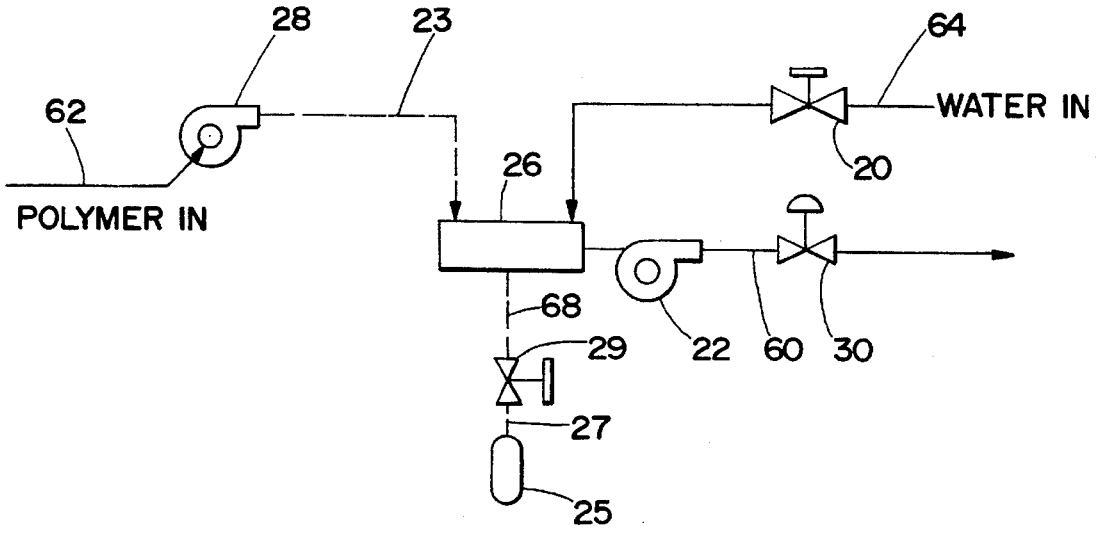
FIG. 11 is yet another schematic of an alternative embodiment wherein the recirculation loop is eliminated.
Figure 12:
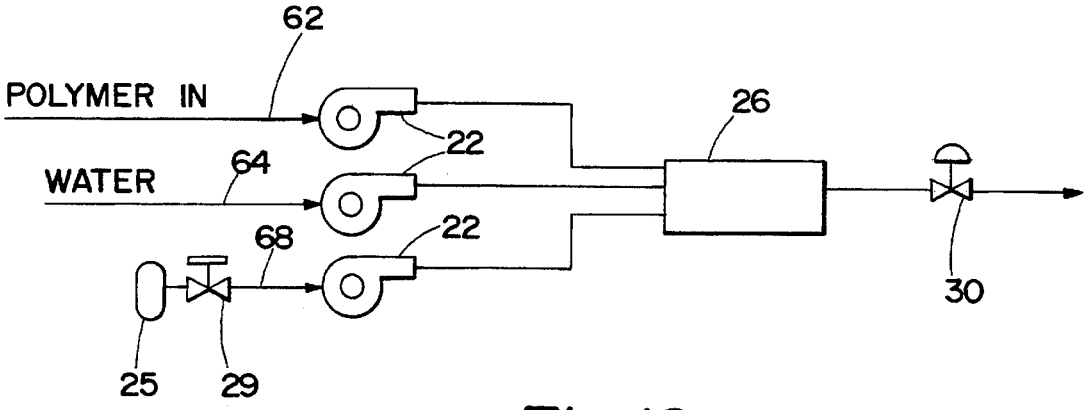
FIG. 12 is another schematic of an alternative embodiment wherein the recirculation loop is eliminated.

FIGS. 6 and 7 shows a practical embodiment of an inventive system which incorporates the principles set forth in FIGS. 1–5. The system 110 is adapted to receive water and neat emulsion polymer in a mixing loop 112 in order to mix and activate the emulsion polymer at desired levels of activation energy. The system 110 further provides a continuous output of inverted emulsion polymer at desired rates through discharge outlet 114.

The mixing loop 112 includes a static mixing manifold or chamber 116 and a booster module or centrifugal pump 118 in fluid communication with each other through conduits 120 and 122. The unactivated or neat polymer is introduced through conduit 124 and into the mixing loop 112, for activation, in the premix manifold or chamber 116. The water is supplied to a water inlet 126 which is in fluid communication with the mixing loop 112 through conduit 128. The gas is connected to the system at connection 121 and enters the process through conduit 119.

Neat polymer is supplied from a source to the conduit 124 through shut-off valve 130 and pump 132. The system 110 is capable of automatically selecting the desired concentration of the polymer actives once the desired flow rate of water is selected. This is accomplished by motor 134 coupled through gearbox 136 to the pump 132. The motor 134 receives its power through control panel 140 from electrical cable 138. The gearbox 136 enables an adjustment of the polymer feed rate through the pump 132 to the mixing loop 112.

The gearbox 136 can be calibrated for each polymer utilized, because different solution concentrations produce different flow rates, for the same pump speed. The calibration is accomplished by closing shut-off valve 130 and by filling calibration column 142 with the polymer which is to be used. The calibration column 142 supplies its polymer to the pump 132. By correlating the rate of decrease of polymer in the column 142 to an adjustment member 144 on the gearbox 136, the polymer is delivered at a selected rate to the mixing loop 112. The shut-off valve 130 can then be opened to supply polymer at the desired rate.

Gauges 146 and 148 are coupled to the inlet and discharge sides, respectively, of he pump 132. These gauges provide a visual inspection of proper pump operation. Gauge 146 is a vacuum pressure gauge and indicates suction pressure of the pump. Gauge 148 monitors the discharge pressure of the pump. High level valves on gauge 148 warns of blockage in the pump 132 or in the premix manifold or chamber 116 and leads to a deactivation of the system in order to ascertain and correct the cause of a malfunction.

A means 140 (FIG. 6) responsive to the flow meter acts in conjunction with the regulator 30 (FIG. 1) for selecting a desired output of activated polymer. More particularly, the water is supplied to the mixing 1loop 112 via the conduit 128, a metering valve 150, and a flowrate indicator 152. The flow rate indicator 152 is calibrated in gallons per minute. By adjusting valve 150, one can select the desired rate of output of inverted polymer solution. The flow rate indicator 152 includes a low flow sensor. When a low flow condition is sensed in the system, an impulse is sent through electrical cable 154 to the control panel 140, which deactivates the system an sounds an alarm to alert an operator.

A mixing pressure regulator 156 communicates between the discharge outlet 114 and the mixing loop 112. The mixing pressure regulator 156 contains an adjustment handle 159 for varying pressure within the mixing loop 112 to achieve a desired level of activation of the emulsion polymer.

The booster module or centrifugal pump 118 supplies a motive force for mixing the polymer and water and for moving it through the mixing loop 112. The centrifugal pump 118 receives its power from the control panel 140 via cable 162. A gauge 164 is provided to visually inspect he operating condition of the pump 118. The gauge 164 is a compound gauge which is coupled to the premix manifold or chamber 116, to indicate the suction pressure of the pump 118. The conduit 120 includes a visual flow indication viewing window, for the mixing loop. Gauge 166 is coupled to the conduit 122 and gives values for the mixing pressure within the mixing loop.

The discharge outlet discharges the inverted polymer either to a tank (not shown) or directly to a processing system (also not shown). Cable 168 communicates between the control panel 140 and the tank. When a predetermined level of inverted polymer solution is sensed in the tank the control panel deactivates the system.

Once the desired levels of output and energy are selected, the system automatically operates the pressure regulator 156 attendant to changes with the flow rate of the water to maintain the level of pressure in the mixing loop 112 which provides the desired level of activation energy. Pressure within the mixing loop 112 dictates how much polymer recirculates, which in turn is directly proportional to the introduction of activation energy. Therefore, with an increases in mixing pressure, via the mixing pressure regulator, the pressure in the loop increases which means more polymer recirculation.

The mixing loop 112 not only provides a balance to achieve a desired output rate and a desired level of inversion energy, but also provides a regulation to prevent a cavitation of pump 118. In order to get a flow rate out of the pump 118, it is necessary to supply it with its net positive suction head (NPSH) requirement. Cavitation or boiling of the liquid occurs if there is a failure to supply the pump 118 with its required NPSH. Therefore the regulator 156 and valve 150 balance the loop 112 and provide variations in the output rate and in the level of activation energy, within the ranges which regulate the NPSH requirement of pump 18. FIG. 8 through 12 disclose alternative embodiments of the present invention with elements already identified above arranged as indicated.

The system is an automatic, efficient, low cost apparatus for mixing and activating emulsion polymers. More particularly, the system 110 provides an ultimate control over a processed polymer concentration which is in the range of about 0.10 to 15 percent. Also, the system 110 automatically provides a variable rate output, while maintaining critical mixing pressures for the introduction of controlled mixing energy to the emulsion polymer.

Those who are skilled in the art will readily perceive how modify the invention still further. Therefore, the appended claims are to be construed to cover all equivalent structures which fall within the true scope and spirits of the invention.

What is claimed is:

1. A system for activating polymer comprising:

a pump having an input and output, a source of polymer, a means for coupling said source of polymer to said input of said pump means so as to create a polymer flow, a source of solvent, a means for coupling said source of solvent to said input of said pump means;

a means for imparting energy on and activating said polymer within said pump means, a mixing manifold with a first input, an output and an agitator means for thoroughly mixing said polymer and said solvent to form a polymer solution and enhancing activation by mixing the polymer solution with activated polymer;

a means for connecting said first input of said mixing manifold and said output of said pump means;

a connection means between said mixing manifold output and said input of said pump means;

a system output distribution means;

a flow divider means located within said connecting means between said output of said pump means and said first input of said manifold, said flow divider means redirecting a first portion of said polymer flow to said first input of said manifold and directing a second portion of said polymer flow to said system output distribution means; and a means for injecting gas into said system.

2. The system of claim 1 wherein said means for imparting energy on and activating said polymer is a high speed impeller located within said pump means.

3. The system of claim 2 wherein said pump means is a derated centrifugal pump.

4. The system of claim 2 wherein said pump means is derated by a factor in the range of 2–7.

5. The system of claim 1 further comprising a pressure regulator for reducing pressure built up by said pump means, said pressure regulator and said output of said pump means being connected to said first input of said manifold.

6. The system of claim 5 wherein the polymer flow from said output of said pump means is divided by said flow divider means so that approximately 5%–60% of the flow goes to said first input of said manifold and approximately 95%–40% of said flow goes to said pressure regulator.

7. The system of claim 1 wherein the mixing manifold further includes a second input with said source of polymer coupled to said pump means through said second input; said input of said pump means coupled to said mixing manifold output so that the polymer enters the pump means with said first portion of said polymer redirected to said first input of said manifold.

8. The system of claim 1 wherein said source of solvent comprises a means for introducing water through said input of said pump means to said first input of said manifold.

9. The system of claim 1 wherein said gas injecting means is attached to said system output distribution means.

10. The system of claim 1 wherein said gas injecting means is attached to said input of said pump means.

11. The system of claim 1 wherein said gas injecting means is attached to said output of said pump means.

* * * * *